US011830453B2

(12) United States Patent
Jung et al.

(10) Patent No.: US 11,830,453 B2
(45) Date of Patent: Nov. 28, 2023

(54) DISPLAY APPARATUS FOR ADJUSTING CURRENT PROVIDED TO LIGHT EMITTING ELEMENT AND CONTROL METHOD THEREOF

(71) Applicant: SAMSUNG ELECTRONICS CO., LTD., Suwon-si (KR)

(72) Inventors: Jonghoon Jung, Suwon-si (KR); Sungyeol Kim, Suwon-si (KR); Seungyong Shin, Suwon-si (KR); Junsung Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/742,992

(22) Filed: May 12, 2022

(65) Prior Publication Data

US 2022/0270562 A1 Aug. 25, 2022

Related U.S. Application Data

(63) Continuation of application No. PCT/KR2020/010519, filed on Aug. 10, 2020.

(30) Foreign Application Priority Data

Nov. 12, 2019 (KR) ..... 10-2019-0144157

(51) Int. Cl.
*G09G 3/36* (2006.01)
*G09G 3/34* (2006.01)

(52) U.S. Cl.
CPC ..... *G09G 3/3648* (2013.01); *G09G 3/3426* (2013.01); *G09G 2320/0233* (2013.01); *G09G 2330/021* (2013.01)

(58) Field of Classification Search
CPC ..... G09G 3/3648; G09G 3/3426; G09G 2330/021; G09G 2320/0233
See application file for complete search history.

(56) References Cited

U.S. PATENT DOCUMENTS 7,605,786 B2 * 10/2009 Yamazaki ..... H01L 27/1285 345/204
2006/0038758 A1 2/2006 Routley et al.
(Continued)

FOREIGN PATENT DOCUMENTS

KR 10-2005-0087820 A 8/2005
KR 10-2006-0038847 A 5/2006
(Continued)

OTHER PUBLICATIONS

International Search Report dated Nov. 30, 2020 issued by the International Searching Authority in counterpart International Application No. PCT/KR2020/010519 (PCT/ISA/210).
(Continued)

*Primary Examiner* — Kwang-Su Yang
(74) *Attorney, Agent, or Firm* — Sughrue Mion, PLLC

(57) ABSTRACT

A display apparatus includes a liquid crystal panel, a power supply, a backlight unit including a plurality of sub-blocks configured to radiate light to the liquid crystal panel, and a controller configured to determine a peak voltage and a source voltage supplied to each of the plurality of sub-blocks. Each of the plurality of sub-blocks includes a first switching element configured to receive the peak voltage as a gate voltage, and a second switching element including a drain terminal connected to a source terminal of the first switching element, the second switching element configured to receive an amount of charges corresponding to the source voltage through a gate terminal.

15 Claims, 11 Drawing Sheets

(56) References Cited

U.S. PATENT DOCUMENTS

| | | | | |
|---|---|---|---|---|
| 2010/0007589 | A1* | 1/2010 | Yeo | G09G 3/3413 345/83 |
| 2015/0171156 | A1 | 6/2015 | Miyake | |
| 2015/0296580 | A1* | 10/2015 | Kim | G09G 3/3426 315/294 |
| 2017/0270873 | A1 | 9/2017 | An et al. | |

FOREIGN PATENT DOCUMENTS

| | | | |
|---|---|---|---|
| KR | 10-2015-0068909 | A | 6/2015 |
| KR | 10-2017-0109437 | A | 9/2017 |
| KR | 10-2018-0019433 | A | 2/2018 |

OTHER PUBLICATIONS

International Written Opinion dated Nov. 30, 2020 issued by the International Searching Authority in counterpart International Application No. PCT/KR2020/010519 (PCT/ISA/237).

* cited by examiner

DISPLAY APPARATUS FOR ADJUSTING CURRENT PROVIDED TO LIGHT EMITTING ELEMENT AND CONTROL METHOD THEREOF

CROSS-REFERENCE TO RELATED APPLICATIONS

This application is a by-pass continuation of International Application No. PCT/KR2020/010519, filed on Aug. 10, 2020, in the Korean Intellectual Property Receiving Office, which is based on and claims priority to Korean Patent Application No. 10-2019-0144157, filed on Nov. 12, 2019, in the Korean Intellectual Property Office, the disclosures of which are incorporated by reference herein in their entireties.

BACKGROUND

1. Field

The disclosure relates to a display apparatus including a backlight unit and a liquid crystal panel.

2. Description of Related Art

In general, a display apparatus includes a backlight unit and a liquid crystal panel, and converts electrical information into visual information and displays the converted visual information by controlling an amount of light that is radiated from the backlight unit and passes through the liquid crystal panel.

The backlight unit may be controlled in a passive matrix method, and in this case, may have low efficiency due to application of a high current in that a lighting time for each arrangement of light emitting elements within one frame is limited, and may require an additional drive integrated circuit (IC).

Also, the backlight unit may be controlled in an active matrix method including a capacitor, and in this case, may increase the efficiency due to application of a low current, but has a limitation in providing a high luminance contrast ratio.

SUMMARY

Provided are a display apparatus including a backlight unit capable of providing a high luminance while driving at a low current in an active matrix method, and a control method thereof.

Additional aspects will be set forth in part in the description which follows and, in part, will be apparent from the description, or may be learned by practice of the presented embodiments.

In accordance with an aspect of the disclosure, a display apparatus may include a liquid crystal panel, a power supply, a backlight unit including a plurality of sub-blocks configured to radiate light to the liquid crystal panel, and a controller configured to determine a peak voltage and a source voltage supplied to each of the plurality of sub-blocks. Each of the plurality of sub-blocks includes a first switching element configured to receive the peak voltage as a gate voltage, a second switching element including a drain terminal connected to a source terminal of the first switching element, the second switching element configured to receive an amount of charges corresponding to the source voltage through a gate terminal, and a light emitting element connected in series with a source terminal of the second switching element, the light emitting element configured to receive a first current from the power supply through the first switching element and the second switching element.

In accordance with an aspect of the disclosure, a control method of a display apparatus that includes a liquid crystal panel, a power supply, and a backlight unit including a plurality of sub-blocks provided with a first switching element configured to receive a peak voltage as a gate voltage, and a second switching element comprising a drain terminal connected to a source terminal of the first switching element and configured to receive an amount of charges corresponding to a source voltage, may include determining a luminance corresponding to each of the plurality of sub-blocks based on image data, determining a source voltage corresponding to the luminance corresponding to each of the plurality of sub-blocks, determining a sub-block among the plurality of sub-blocks requiring a luminance greater than or equal to a first preset value, and determining a peak voltage corresponding to the determined sub-block to be greater than or equal to a second preset value.

BRIEF DESCRIPTION OF DRAWINGS

The above and other aspects, features, and advantages of certain embodiments of the present disclosure will be more apparent from the following description taken in conjunction with the accompanying drawings, in which.

DETAILED DESCRIPTION

Figure 1:
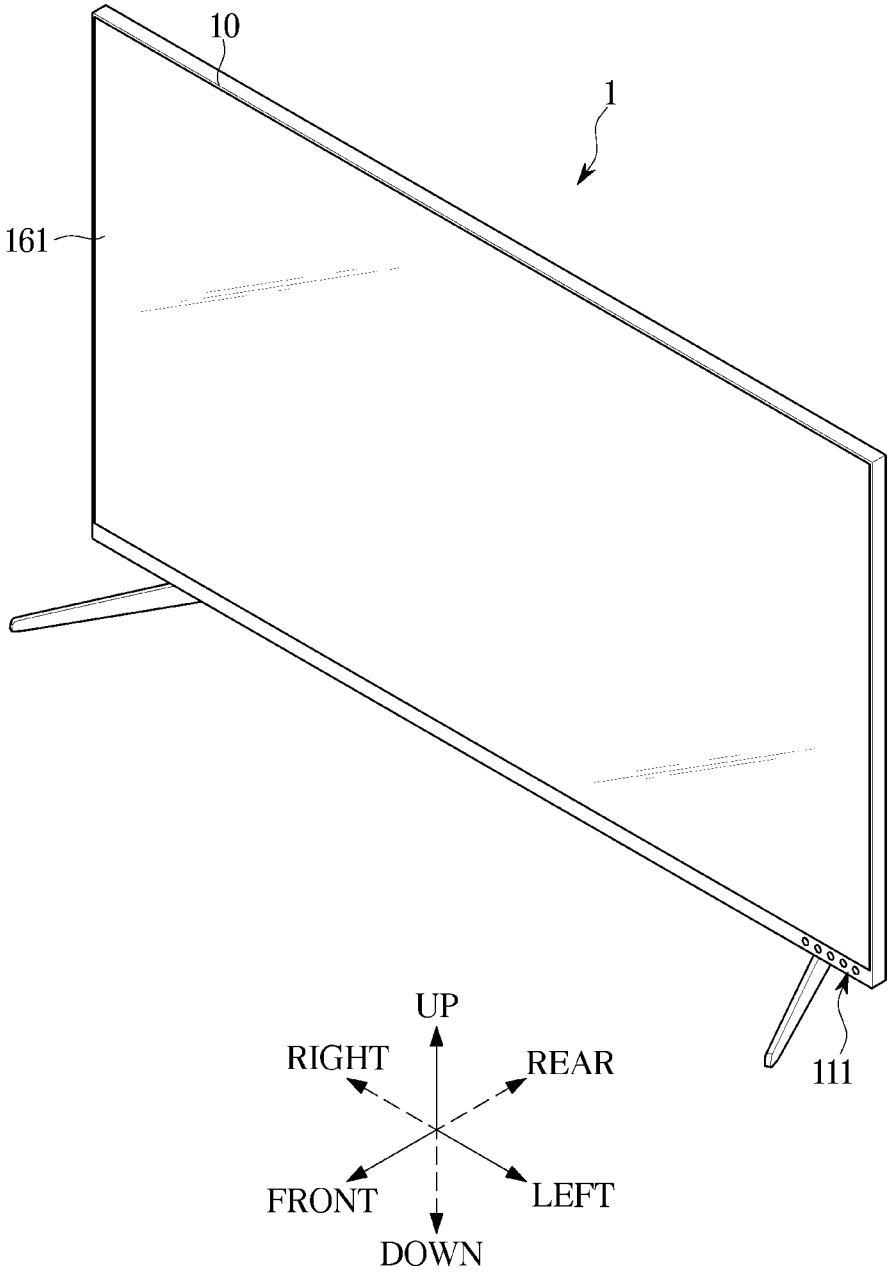
FIG. 1 is an external view of a display apparatus according to an embodiment of the present disclosure.

Embodiments described in the present specification and the configurations shown in the drawings are examples, and various modifications may be made to replace the embodiment and drawings of the present specification.

Throughout the specification, when an element is referred to as being "connected" to another element, it includes not only a direct connection but also an indirect connection, and the indirect connection includes connecting through a wireless network.

The terms used herein are for the purpose of describing the embodiment and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms, and these terms are only used to distinguish one component from another. For example, without departing from the scope of the present disclosure, the first component may be referred to as a second component, and similarly, the second component may also be referred to as a first component.

In addition, terms such as "~unit", "~part," "~block," "~member," "~module." and the like may denote a unit for processing at least one function or operation. For example, the terms may refer to at least one hardware such as a field-programmable gate array (FPGA)/an application specific integrated circuit (ASIC), at least one software stored in a memory, or at least one process processed by a processor.

In each step, an identification numeral is used for convenience of explanation, the identification numeral does not describe the order of the steps, and each step may be performed differently from the order specified unless the context clearly states a particular order.

Hereinafter, an embodiment of the present disclosure will be described in detail with reference to the accompanying drawings.

Figure 2:
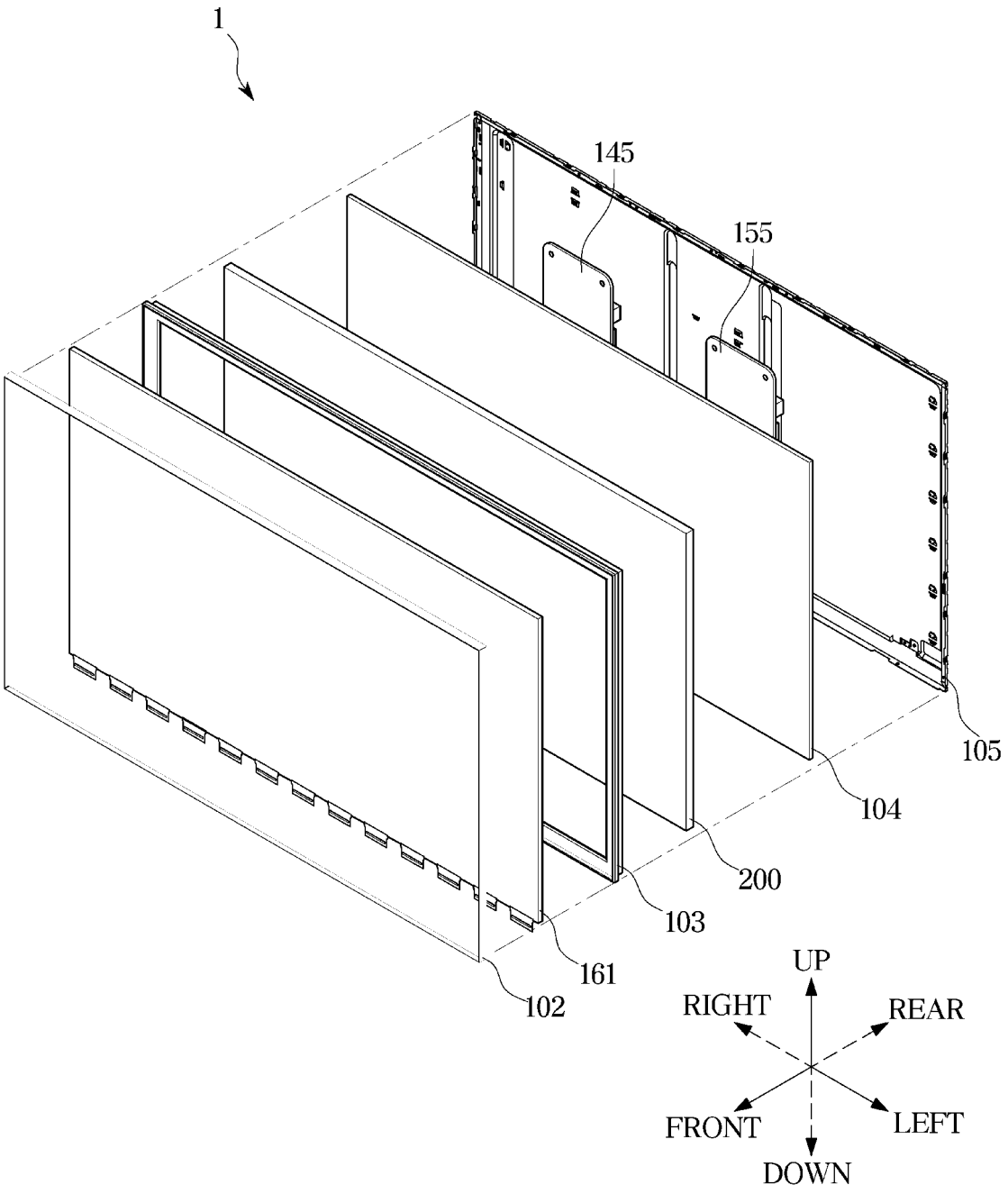
FIG. 2 is an exploded view of the display apparatus according to an embodiment of the present disclosure.
Figure 3:
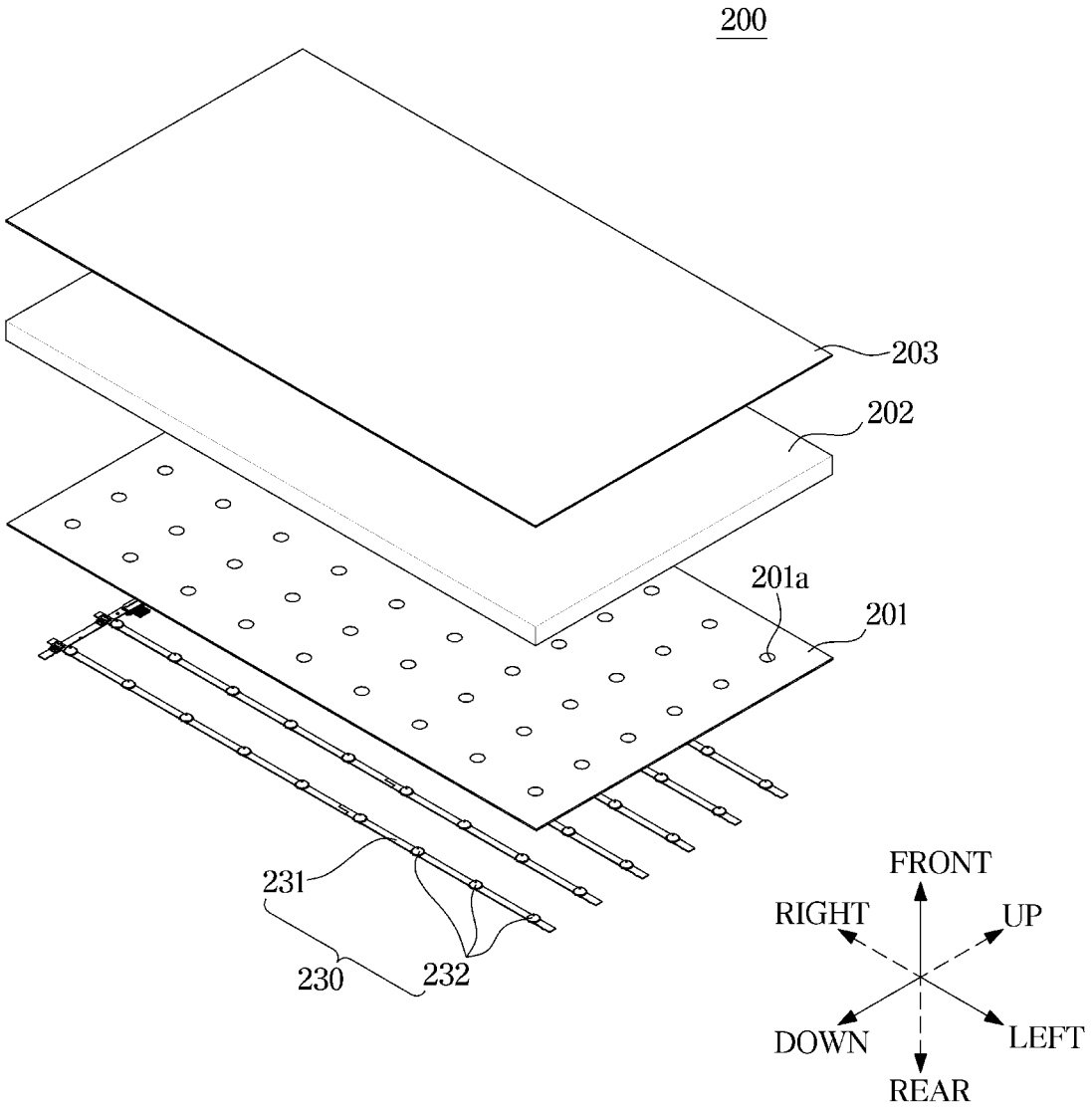
FIG. 3 is an exploded view of a backlight unit according to an embodiment of the present disclosure.

FIG. 1 is an external view of a display apparatus according to an embodiment of the present disclosure, FIG. 2 is an exploded view of the display apparatus according to an embodiment of the present disclosure, and FIG. 3 is an exploded view of a backlight unit according to an embodiment of the present disclosure.

Referring to FIG. 1, a display apparatus 1 according to an embodiment is an apparatus capable of processing image data received from the outside and visually displaying an image.

As illustrated in FIG. 1, the display apparatus 1 may be implemented as a TV, but the embodiment of the display apparatus 1 is not limited thereto. For example, the display apparatus 1 may implement a computer monitor, or may be included in a navigation terminal device or various portable terminal devices. Herein, the portable terminal devices may include a notebook computer, a smart phone, a tablet personal computer, and a personal digital assistant (PDA).

The display apparatus 1 includes a main body 10 to form an appearance and accommodates or support various parts constituting the display apparatus 1, and a liquid crystal panel 161 to display an image.

The main body 10 may be provided with an input button 111 for receiving a command of a user related to power on/off, volume control, channel control, and screen mode switching of the display apparatus 1. In addition, a remote controller may be provided separately from the input button 111 provided on the main body 10 to receive a command of the user related to the control of the display apparatus 1.

Various components may be provided inside the main body 10 to display an image on the liquid crystal panel 161.

For example, as illustrated in FIG. 2, the main body 10 includes a backlight unit 200 to emit surface light to the front, the liquid crystal panel 161 to block or pass light emitted from the backlight unit 200, a power assembly 145 to supply power to the liquid crystal panel 161 and the backlight unit 200, and a control assembly 155 to control operations of the liquid crystal panel 161 and the backlight unit 200.

The main body 10 includes a bezel 102, a frame middle mold 103, a bottom chassis 104, and a rear cover 105. The bezel 102, the frame middle mold 103, the bottom chassis 104, and the rear cover 105 support and fix the power assembly 145, the control assembly 155, the liquid crystal panel 161, and the backlight unit 200.

In general, the liquid crystal panel 161 displays image data by applying a grayscale voltage to a liquid crystal layer provided with a liquid crystal material having anisotropic dielectric constant injected between two substrates and adjusting an amount of light transmitted through the substrates.

The liquid crystal panel 161 may be composed of pixels. Although a pixel, which is the smallest unit constituting a screen displayed through the liquid crystal panel 161, is referred to as a dot or a pixel, hereinafter, it will be referred to as a pixel for convenience of description.

Each pixel may receive an electrical signal representing image data, and may output an optical signal corresponding to the received electrical signal. As such, the optical signals output from the plurality of pixels included in the liquid crystal panel 161 may be combined to display image data on the liquid crystal panel 161.

In this case, a pixel electrode, which is provided in each pixel, is connected to a gate line and a source line. The gate line and the source line may be configured by a method known to those skilled in the art, and detailed description thereof will be omitted.

Because the liquid crystal panel 161 may not emit light by itself, as described above, the display apparatus 1 may be provided with the backlight unit 200 to project backlight to the liquid crystal panel 161.

Accordingly, the display apparatus 1 may display the desired image data by adjusting an intensity of the grayscale voltage applied to the liquid crystal layer of the liquid crystal panel 161 to control a transmittance of the backlight passing through the liquid crystal layer.

The backlight unit 200 may be implemented in a direct type or an edge type, and may also be implemented in various types known to those skilled in the art. Hereinafter, an example in which the backlight unit 200 is provided as the direct type will be described. However, the embodiment of the present disclosure is not limited to the above example, and the backlight unit 200 may be implemented in various known forms.

As illustrated in FIG. 3, the backlight unit 200 may include a light emitting element array 230 to generate light, a reflective sheet 201 to reflect the light, a diffuser plate 202 to disperse the light, and an optical sheet 203 to enhance a luminance.

The light emitting element array 230 is provided at a rearmost portion of the backlight unit 200 and may include a plurality of sub-blocks 232. The sub-block 232 may include at least one light emitting element to generate light, and may include a separate driving circuit for each of the sub-blocks 232. The plurality of sub-blocks 232 may be disposed in parallel to each other to face the liquid crystal panel 161, and may emit the light toward the front.

The light emitting element array 230 may include a support 231 to support and fix the plurality of sub-blocks 232.

The plurality of sub-blocks 232 may be mounted in a predetermined arrangement to have a uniform luminance. For example, the plurality of sub-blocks 232 may be mounted on the support 231 at equal intervals. A form in which the plurality of sub-blocks 232 is disposed on the support 231 may vary.

In this case, the support 231 may supply power to the plurality of sub-blocks 232. That is, current may be applied and power may be supplied to the light emitting element included in each of the plurality of sub-blocks 232 through the support 231. The support 412 may be made of a synthetic resin including a conductive power supply line for supplying power to the plurality of sub-blocks 232 or may be configured as a printed circuit board (PCB).

The light emitting element included in each of the plurality of sub-blocks 232 may be any one of a light emitting diode (LED), an organic LED (OLED), and a quantum dot-organic LED (QD-OLED) capable of emitting light based on a supplied current. However, the type of the light emitting element is not limited thereto, and any device that emits light depending on current may be included without limitation.

The reflective sheet 201 may be provided in front of the light emitting element array 230, and may reflect the light traveling to the rear of the backlight unit 200 to the front.

A passing hole 201*a* is formed on the reflective sheet 201 at a position corresponding to the sub-block 232. The light emitting element of the sub-block 232 may pass through the passing hole 201*a* and protrude in front of the reflective sheet 201. Because the light emitting element of the sub-block 232 emits light in various directions from the front of the reflective sheet 201, a part of the light emitted from the light emitting element may travel to the rear. A reflective film included in the reflective sheet 201 may reflect the light, which is emitted from the light emitting element to the rear, to the front.

The diffuser plate 204 may be provided in front of the light emitting element array 230 and the reflective sheet 201, and may uniformly disperse the light emitted from the light emitting element of the light emitting element array 230.

The light emitting elements are located in various places on a rear surface of the backlight unit 200. Even when the plurality of light emitting elements is arranged at equal intervals on the rear surface of the backlight unit 200, a non-uniform luminance may occur depending on the positions of the light emitting elements. The diffuser plate 204 may diffuse the light emitted from the light emitting elements in the diffuser plate 204 in order to remove non-uniformity in luminance due to the light emitting elements. As such, the diffuser plate 204 may uniformly emit the light incident from the light emitting element array 230 to a front surface thereof.

The diffuser plate 204 may be made of poly methyl methacrylate (PMMA) or polycarbonate (PC) to which a diffusion agent for light diffusion is added.

The optical sheet 203 may include various sheets for improving the luminance and uniformity of the luminance. For example, the optical sheet 203 may include a diffusion sheet, a first prism sheet, a second prism sheet, and a reflective polarizing sheet.

The backlight unit 200 may further include a quantum dot film capable of converting a color of light emitted from the light emitting element according to an embodiment. In this case, the quantum dot film may be provided between the diffuser plate 202 and the optical sheet 203. In addition, the backlight unit 400 may include various sheets according to an embodiment.

In the above, a physical structure of the display apparatus 1 has been described in detail. Hereinafter, each component of the display apparatus 1 will be described in detail, and control of the backlight unit 200 to support a high luminance will be briefly described.

Figure 4:
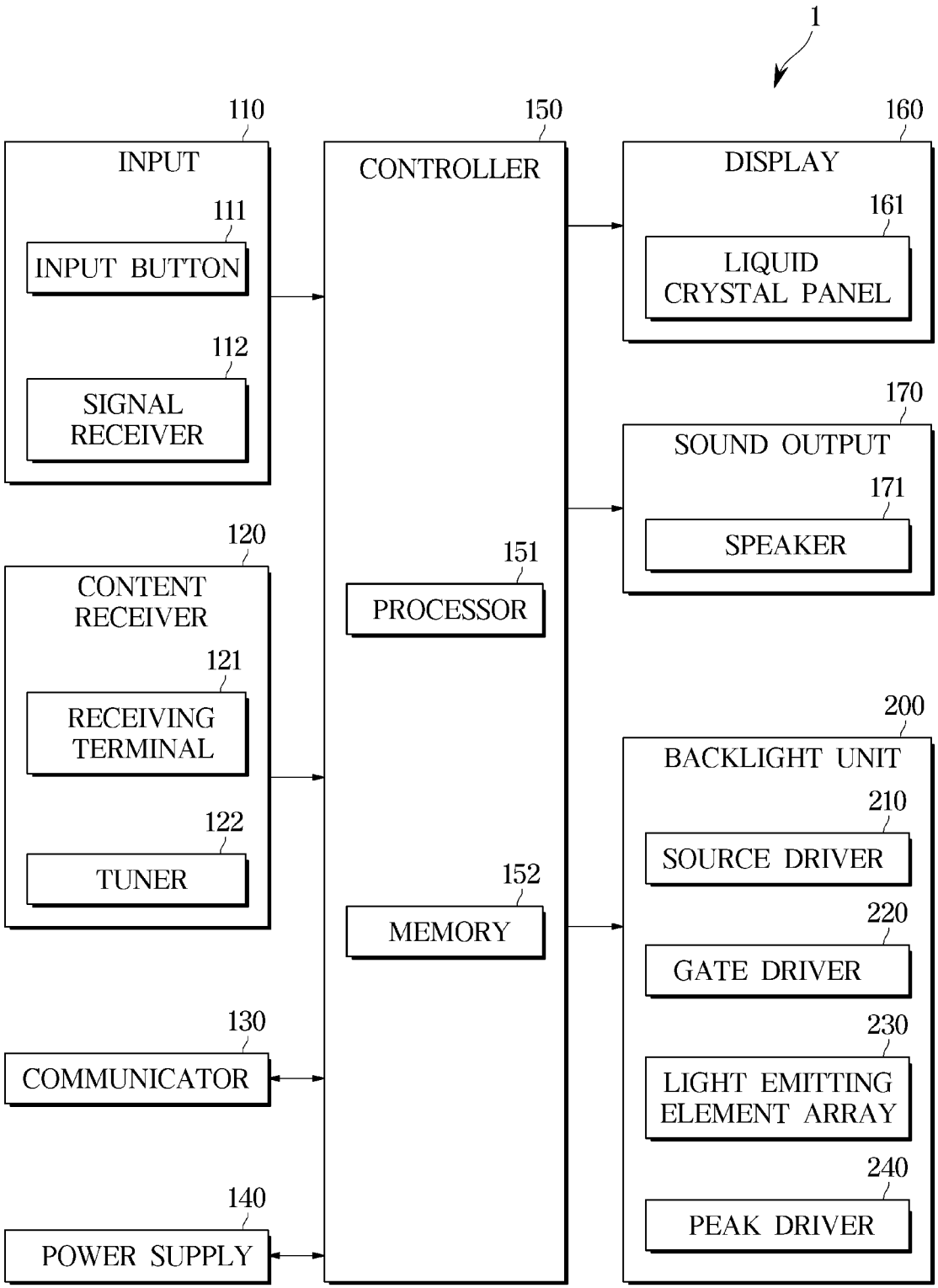
FIG. 4 is a control block diagram of the display apparatus according to an embodiment of the present disclosure.
Figure 5:
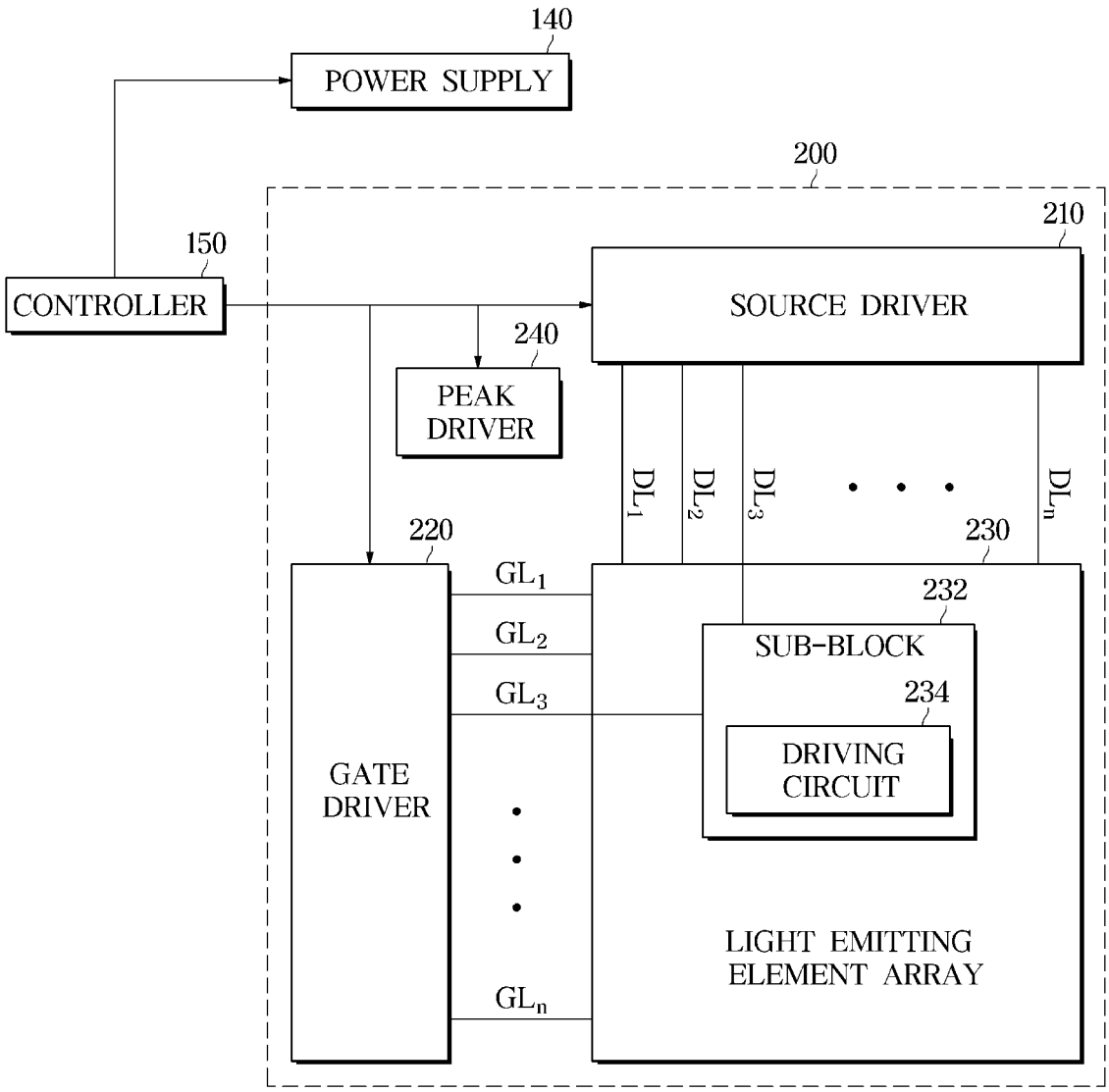
FIG. 5 is a control block diagram of the backlight unit according to an embodiment of the present disclosure.
Figure 6:
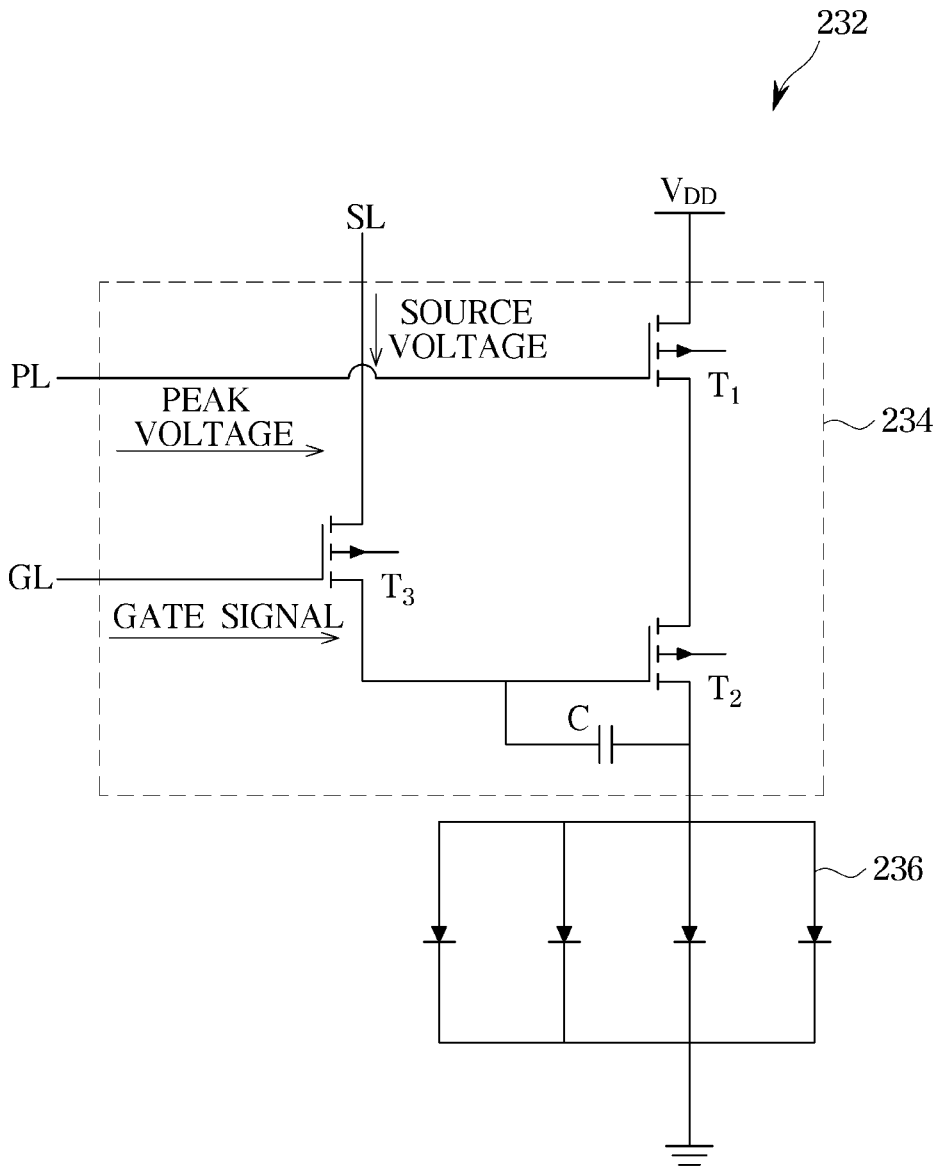
FIG. 6 is a circuit configuration diagram of a sub-block of the backlight unit according to an embodiment of the present disclosure.

FIG. 4 is a control block diagram of the display apparatus according to an example embodiment. FIG. 5 is a control block diagram of the backlight unit according to an example embodiment. FIG. 6 is a circuit configuration diagram of a sub-block of the backlight unit according to an example embodiment.

Referring to FIG. 4, the display apparatus 1 according to an embodiment includes an input 110 to receive various control commands from the user, a content receiver 120 to receive a content including an image and a sound from an external device, a communicator 130 to transmit and receive various data such as the content through a communication network, a power supply 140 to supply power to each component of the display apparatus 1, a controller 150 to process a content received from the outside and to control each component to output an image and a sound corresponding to the content, a display 160 including the liquid crystal panel 161 to display an image corresponding to the content, a sound output 170 to output a sound corresponding to the content, and the backlight unit 200 to provide a backlight. However, according to an embodiment, the display apparatus 1 may omit some of the components described above.

The input 110 according to an embodiment may receive various control commands from the user.

For example, as illustrated in FIG. 4, the input 110 may include an input button 111. The input button 111 according to an embodiment may include a power button to turn on/off the power of display apparatus 1, a channel button to change the channel received by the content receiver 120, a volume button to adjust the volume of sound output from the sound output 170, and the like.

Various buttons included in the input button 111 may include a push switch or a membrane switch to sense a pressure of the user, or a touch switch to sense a touch of a part of a body of the user. However, the present disclosure is not limited thereto, and the input button 111 may include various input means capable of outputting an electrical signal to the controller 150 in response to a specific motion of the user.

The input 110 according to an embodiment may also include a signal receiver 112 to receive a remote control signal of the remote controller.

In this case, the remote controller to obtain a user input may be provided separately from the display apparatus 1, and may obtain a user input and transmit a wireless signal corresponding to the user input to the display apparatus 1.

The signal receiver 112 may receive the wireless signal from the remote controller and output an electrical signal corresponding to the user input to the controller 150.

In addition, the input 110 may include various known components that may receive a control command input from the user, and there is no limitation thereto. When the liquid crystal panel 161 is implemented in a touch screen type, the liquid crystal panel 161 may perform the function of the input 110.

The content receiver 120 according to an embodiment may include a receiving terminal 121 and a tuner 122 to receive contents including image data and/or sound signals from content sources.

The receiving terminal 121 may include a RF coaxial cable connector to receive a broadcast signal including a content from an antenna, a high definition multimedia interface (HDMI) connector to receive a content from a set-top box or a multimedia playback device, a component video connector, a composite video connector, a D-sub connector, and the like.

The tuner 122 may receive broadcast signals from a broadcast reception antenna or a wired cable and extract a broadcast signal of a channel selected by the user from among the broadcast signals. For example, the tuner 122 may pass a broadcast signal having a frequency corresponding to a channel selected by the user from among the plurality of broadcast signals received through the broadcast reception antenna or the wired cable, and may block broadcast signals having different frequencies.

As such, the content receiver 120 may receive image data and sound signals from the content sources through the receiving terminal 121 and/or the tuner 122, and may output the image data and/or sound signals to the controller 150.

The communicator 130 according to an embodiment may receive various contents through a wireless communication or wired communication. To this end, the communicator 130 may include a wireless communication module to support a wireless communication method and a wired communication module to support a wired communication method.

The wireless communication may include, for example, a cellular communication using at least one of 5th generation (5G), LTE, LTE Advanced (LTE-A), code division multiple access (CDMA), wideband CDMA (WCDMA), a universal mobile telecommunications system (UMTS), a wireless broadband (Wibro), a global system for mobile communications (GSM), and the like. According to an embodiment, the wireless communication may include, for example, at least one of wireless fidelity (WiFi), Bluetooth, Bluetooth low energy (BLE), ZigBee, a near field communication (NFC), a magnetic secure transmission, a radio frequency (RF), and a body area network (BAN). According to an embodiment, the wireless communication may include GNSS.

The wired communication method includes, but is not limited to, peripheral component interconnect (PCI), PCI-express, universal serial bus (USB), and the like.

The power supply 140 according to an embodiment may supply power to each component of the display apparatus 1.

For example, the power supply 140 may supply power to the display 160. Specifically, the power supply 140 may supply each driving voltage of a source driver and a gate driver of the display 160, and may supply a common voltage Vcom required for the liquid crystal layer of the liquid crystal panel 161 through each pixel electrode.

The power supply 140 may also supply power to the backlight unit 200. Specifically, the power supply 140 may supply each driving voltage of a source driver 210, a gate driver 220, and a peak driver 240 of the backlight unit 20, and may also transmit a voltage to the light emitting element array 230. The power supply to the backlight unit 200 will be described in detail later.

To this end, the power supply 140 may include a DC/DC converter and a PWM driver, and may be provided in the form of a separate integrated circuit (IC) according to an embodiment and correspond to the power assembly 145.

The controller 150 according to an embodiment may include at least one memory 152 storing a program for performing the above-described operation and an operation, which will be described later, and at least one processor 151 for executing the stored program, and may correspond to the control assembly 155.

The processor 151 according to an embodiment may obtain image data corresponding to a content by processing the content received through the content receiver 120 or the communicator 130.

The processor 151 according to an embodiment may also control the display 160 and the backlight unit 200 based on the image data to display a corresponding image.

The processor 151 according to an embodiment may determine a luminance corresponding to each of the plurality of sub-blocks 232 included in the backlight unit 200 based on the image data. That is, the processor 151 may determine the luminance required for each of the sub-blocks 232 based on the image data.

Specifically, the processor 151 may determine a gradation corresponding to each pixel of the liquid crystal panel 161 based on the image data, and may determine the luminance of the sub-block 232 corresponding to each pixel of the liquid crystal panel 161 based on the determined grayscale.

In other words, the sub-block 232 of the backlight unit 200 irradiating light to a pixel requiring a low gradation may be determined to require a low luminance, and the sub-block 232 of the backlight unit 200 irradiating light to a pixel requiring a high gradation may be determined to require a high luminance.

The determination of luminance for each of the plurality of sub-blocks 232 of the backlight unit 200 may be performed in units of frames.

The processor 151 according to an embodiment may determine a source voltage corresponding to the sub-block 232 so that light may be radiated with a luminance required by each of the sub-blocks 232.

In this case, the processor 151 may determine a separate peak voltage to support an instantaneous high luminance for a high dynamic range (HDR) function in addition to the source voltage.

Specifically, each of the sub-blocks 232 may further include a separate switching element for supporting the HDR function in addition to the switching element for adjusting the current transferred to the light emitting element based on the source voltage. In this case, the peak voltage is applied as a gate voltage of the separate switching element, so that an instantaneous high current may be supported to the light emitting element of the sub-block 232 when the HDR function is supported.

In this case, the processor 151 may determine the sub-block 232 requiring a luminance equal to or greater than a preset value among the plurality of sub-blocks 232 based on the image data, and may determine the peak voltage corresponding to the determined sub-block 232 to be greater than or equal to the preset value so that an amount of current transferred to the light emitting element of the determined sub-block 232 is increased.

A configuration in which the processor 151 determines the source voltage and the peak voltage will be described in detail later.

The memory 152 according to an embodiment may store information on a correlation between the luminance and the source voltage, information on a correlation between the luminance and the peak voltage, and the like.

In order to store various types of information, the memory 152 may be implemented as at least one of a non-volatile memory device, such as cache, a read only memory (ROM), a programmable ROM (PROM), an erasable PROM (EPROM), an electrically EPROM (EEPROM), and a flash memory, and a volatile memory device such as a random access memory (RAM). However, the present disclosure is not limited thereto, and any type capable of storing various types of information may be used as the type of memory 152.

The display 160 according to an embodiment may display an image by receiving image data from the controller 150 and driving the liquid crystal panel 161 based on the received image data.

To this end, the display 160 includes a source driver, a gate driver, and a timing controller to transmit a gate control signal and a source control signal to control overall operations of the source driver and the gate driver.

The display 160 also includes the plurality of gate lines to transmit a gate signal and the plurality of source lines formed to cross the gate lines to transmit a gradation voltage, and includes a liquid crystal panel 161 including a plurality of pixel electrodes in a matrix form connected through switching elements formed in a region surrounded by the gate lines and the source lines and serving as switches between the gate lines and the source lines.

The switching element may be a thin film transistor (TFT) according to an embodiment, and may be implemented as various elements known to those skilled in the art.

In this case, each of the pixels may display image data by rotating a liquid crystal of the liquid crystal layer by an electric field between the pixel electrode to which the gradation voltage is applied and the common electrode to which the common voltage Vcom is applied through the thin film transistor and adjusting the amount of light transmitted.

The sound output 170 according to an embodiment may receive sound data of content received through the content receiver 120 or the communicator 130 under the control of the processor 151 and output sound. In this case, the sound output 170 may include one or more speakers 171 to convert an electrical signal into a sound signal.

The backlight unit 200 according to an embodiment includes the light emitting element array 230 to radiate the liquid crystal panel 161 with light, the source driver 210 to supply the source voltage to the light emitting element array 230, the gate driver 220 to supply the gate signal to the light emitting element array 230, and the peak driver 240 to supply the peak voltage to the light emitting element array 230.

According to an embodiment, the peak driver 240 may be configured as a single IC with the source driver 210 or as a separate IC as illustrated in the drawing.

Also, according to an embodiment, the backlight unit 200 may include a timing controller to control the timing of the source driver 210, the gate driver 220, and the peak driver 240, and according to an embodiment, the timing controller may be provided as a single IC with the controller 150 or as a separate IC. Hereinafter, it will be described that the controller 150 also performs the function of the timing controller.

As illustrated in FIG. 5, the backlight unit 200 includes a plurality of gate lines $GL_1$, $GL_2$, $GL_3$ . . . . $GL_m$ to transmit the gate signal, and a plurality of source lines $DL_1$, $DL_2$, $DL_3$ . . . $DL_n$ formed to cross the gate lines $GL_1$, $GL_2$, $GL_3$ . . . $GL_m$ to transmit the source voltage, and includes the light emitting element array 230 including the plurality of sub-blocks 232 in a matrix form connected through the switching elements formed in a region surrounded by the gate lines $GL_1$, $GL_2$, $GL_3$ . . . $GL_m$ and the source lines $DL_1$, $DL_2$, $DL_3$ . . . $DL_n$ and serving as switches between the gate lines $GL_1$, $GL_2$, $GL_3$ . . . $GL_m$ and the source lines $DL_1$, $DL_2$, $DL_3$ . . . $DL_n$.

That is, the light emitting element array 230 may include the plurality of sub-blocks 232 connected to one gate line and one source line, respectively, and each of the plurality of sub-blocks 232 may include a driving circuit 234 to supply a current to the light emitting element based on the gate signal and the source voltage.

The source driver 210 according to an embodiment may set an output timing of the source voltage, a magnitude of the source voltage, and a polarity according to the source control signal and image data inputted from the controller 150, and may output an appropriate source voltage through the source lines $DL_1$, $DL_2$, $DL_3$ . . . $DL_n$ according to a supply timing.

That is, the source driver 210 may supply the source voltage corresponding to the luminance required by each of the sub-blocks 232 to the corresponding sub-block 232 through the corresponding source line under the control of the controller 150.

In other words, the source driver 210 may convert luminance data corresponding to the image data received from the controller 150 into an analog source voltage based on the driving voltage supplied from the power supply 140, and may apply the converted analog source voltage to the source lines $DL_1$, $DL_2$, $DL_3$ . . . $DL_n$ arranged on the light emitting element array 230, respectively.

The source driver 210 may include at least one source drive IC, and the number of the source drives ICs may be determined depending on standards such as a size and resolution of the light emitting element array 230.

The gate driver 220 according to an embodiment may be connected to one or opposite ends of the gate lines $GL_1$, $GL_2$, $GL_3$ . . . $GL_n$ and may generate a plurality of gate signals using a gate control signal provided from the controller 150 and gate on/off voltages supplied from the power supply 140 and apply the gate signals to the gate lines $GL_1$, $GL_2$, $GL_3$ . . . $GL_m$ arranged on the light emitting element array 230.

The gate driver 220 may include at least one gate drive IC, and the gate drive IC may be determined depending on the standards such as the size and resolution of the light emitting element array 230.

That is, the gate drives IC of the gate driver 220 may receive the gate control signal and sequentially apply the on/off voltage, that is, the on/off signal through the gate lines. Accordingly, the gate drives IC may sequentially turn on/off the switching elements connected to the gate lines.

Accordingly, the luminance data to be displayed on the sub-block 232 connected to the gate line is converted into the source voltage divided into a plurality of voltages and applied to each of the source lines. At this time, the gate signal is sequentially applied to all the gate lines during one frame period, and the source voltage corresponding to the luminance data is applied to all the sub-block 232 rows, so that the light emitting element array 230 may provide the backlight corresponding to one frame to the liquid crystal panel 161.

The peak driver 240 according to an embodiment may supply the peak voltage to the light emitting element array 230.

At this time, the peak driver 240 may supply the peak voltage to each of the plurality of sub-blocks 232 of the light emitting element array 230, and to this end, the peak driver 240 may be electrically connected to each of the sub-blocks 232 through the peak lines.

As such, the peak driver 240 may provide the peak voltage to the sub-blocks 232 to provide an instantaneous high current to the light emitting element of the sub-blocks 232 in order to support the HDR function.

The light emitting element array 230 according to an embodiment may include a plurality of light emitting elements arranged in a matrix form.

The light emitting element array 230 may include the plurality of sub-blocks 232 each including at least one light emitting element to control.

In this case, each of the sub-blocks 232 may include the driving circuit 234, and the driving circuit 234 may be connected to one gate line, one source line, and one peak line to receive a gate signal, a source voltage, and a peak voltage, thereby controlling the connected light emitting elements. Hereinafter, a circuit configuration of the sub-block 232 will be described in detail.

As illustrated in FIG. 6, one of the sub-block 232 includes the driving circuit 234 and at least one light emitting element 236.

The driving circuit 234 includes a first switching element $T_1$ connected to the peak line to receive the peak voltage as a gate voltage, a second switching element $T_2$ including a drain terminal connected to a source terminal of the first switching element $T_1$ and receiving an amount of charges corresponding to the source voltage through a gate terminal, a capacitor C to supply the gate voltage to the second switching element $T_2$ based on charges charged depending on the source voltage, and a third switching element $T_3$ to transfer the charges to the capacitor C based on the source voltage supplied as a drain voltage when the gate signal is supplied from the gate driver 220 and turned on.

In this case, the light emitting element 236 may be connected in series with a source terminal of the second switching element $T_2$ to receive a current from the power supply 140 through the first switching element $T_1$ and the second switching element $T_2$. FIG. 6 illustrates that one of the sub-block 232 includes four of the light-emitting elements 236, but is not limited thereto, and one of the sub-block 232 may include one or more of the light emitting elements 236.

The first switching element $T_1$ may receive a driving voltage $V_{DD}$ applied to a drain terminal thereof from the power supply 140 and may receive the peak voltage supplied from the peak line to a gate terminal thereof.

The second switching element $T_2$ may adjust the amount of current transferred to the light emitting element 236 based on a source voltage corresponding to a required luminance so that the light emitting element 236 may radiate light with the required luminance.

In this case, the second switching element $T_2$ may receive the amount of charges corresponding to the source voltage from the capacitor C through the gate terminal.

To this end, the capacitor C may include one end connected to the gate terminal of the second switching element $T_2$ and the other end connected to the source terminal of the second switching element $T_2$, and the one end connected to the gate terminal of the second switching element $T_2$ may also be connected to the third switching element $T_3$.

The third switching element $T_3$ may receive a gate signal through the gate line, and may receive the source voltage to a drain terminal thereof upon receiving the gate signal to charge the capacitor C.

According to an embodiment, the first switching element $T_1$, the second switching element $T_2$, and the third switching element $T_3$ may be thin film transistors (TFTs), and may be implemented with various elements known to those skilled in the art.

As described above, the controller 150 may determine a luminance required by each of the plurality of sub-blocks 232 based on the image data, and may determine a peak voltage and a source voltage required for each of the sub-blocks 232 based on the determined luminance. Thereafter, the controller 150 may control the source driver 210, the gate driver 220, and the peak driver 240 to supply the peak voltage and the source voltage corresponding to each of the sub-blocks 232. In this case, the controller 150 may control the power supply 140 to supply power necessary for the source driver 210, the gate driver 220, the peak driver 240, and the light emitting element array 230.

In the above, the configuration of the display apparatus 1 has been described. Hereinafter, an operation of the backlight unit 200 of the display apparatus 1 will be described in detail.

Figure 7:
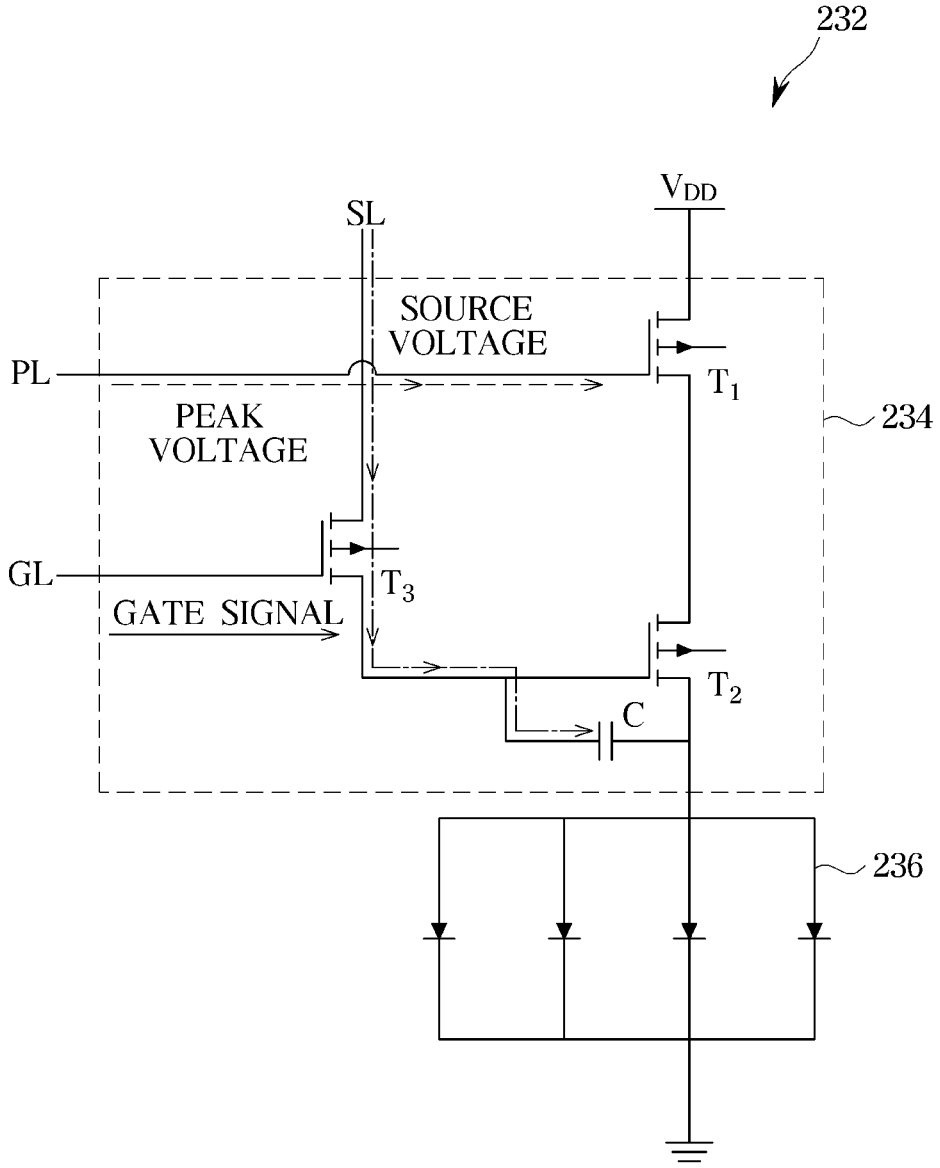
FIG. 7 is a diagram illustrating a case in which a gate signal is applied to the sub-block of the backlight unit according to an embodiment of the present disclosure.
Figure 8:
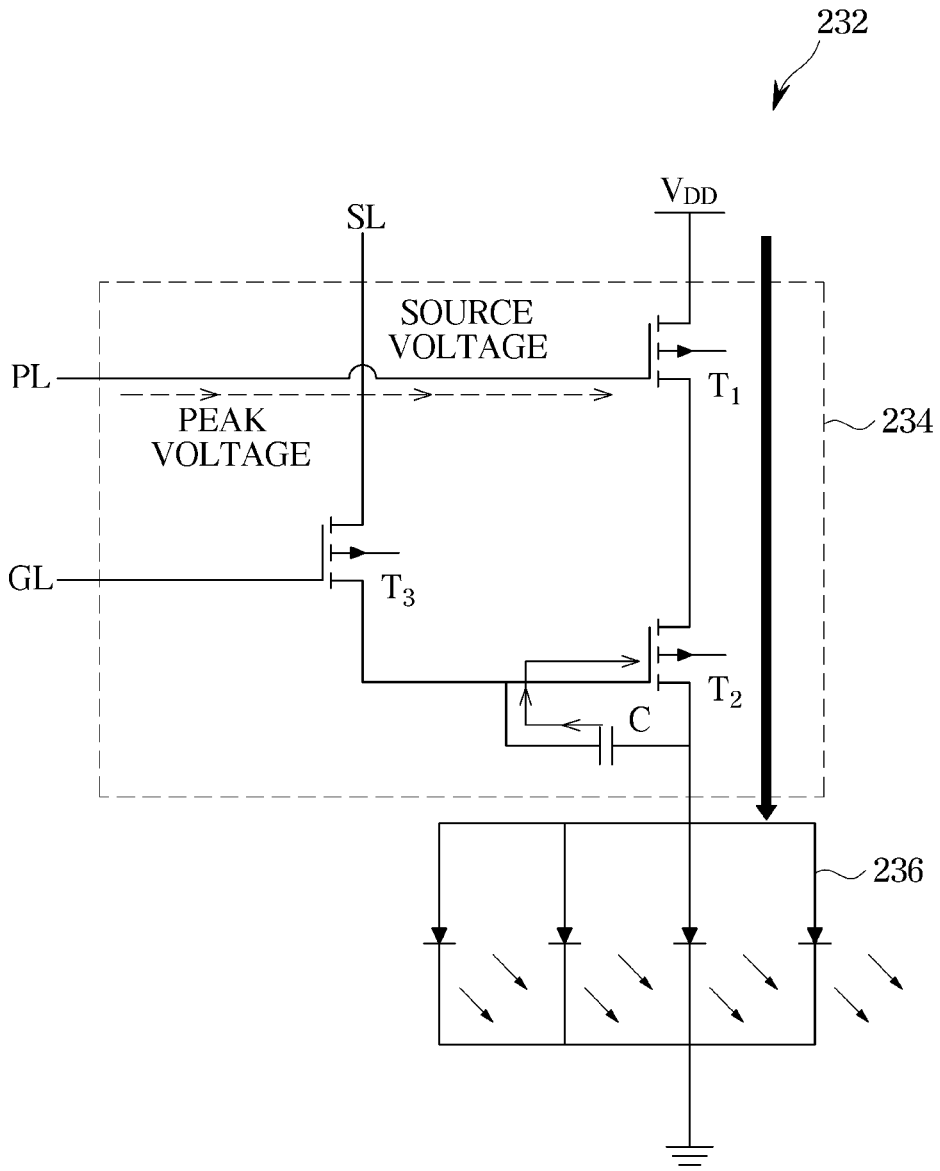
FIG. 8 is a diagram illustrating a case in which the sub-block of the backlight unit turns on a light emitting element according to an embodiment of the present disclosure.
Figure 9:
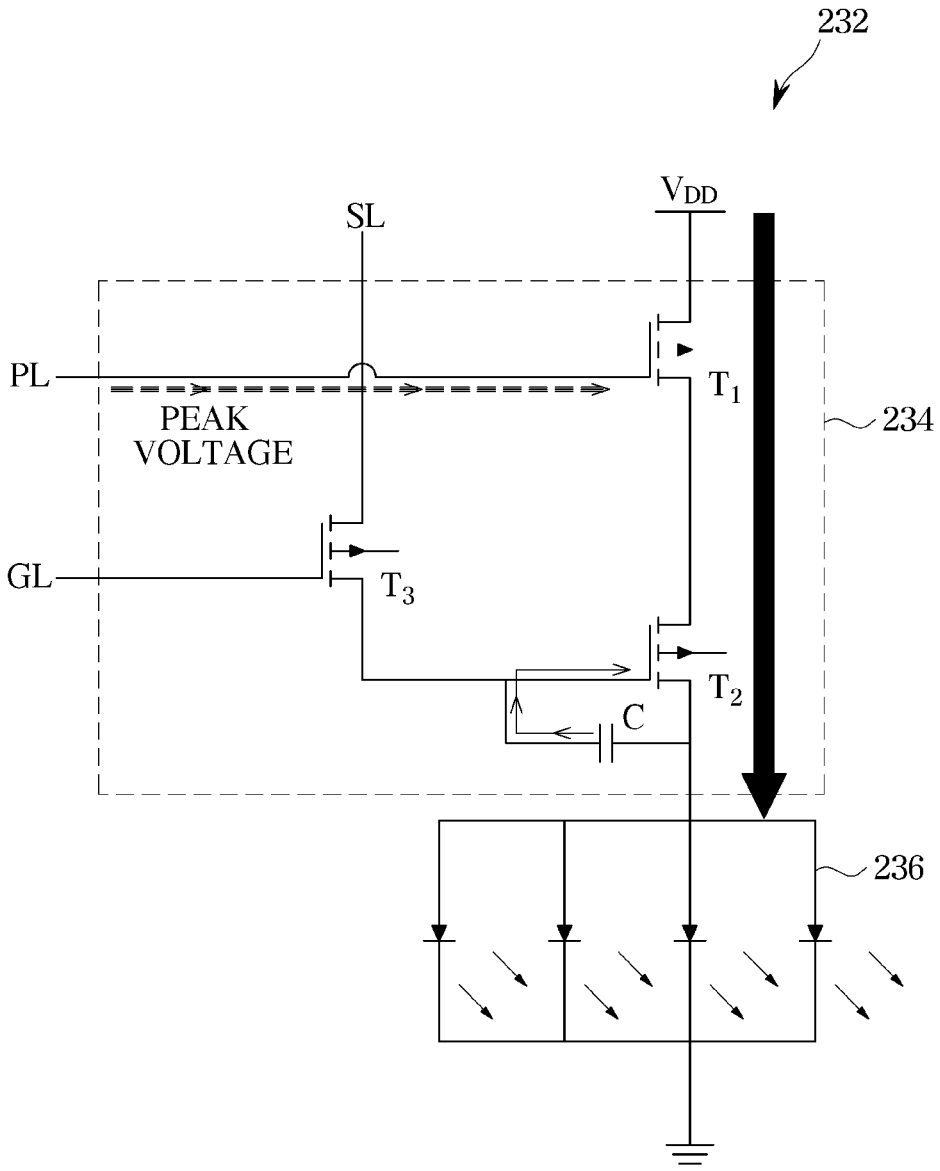
FIG. 9 is a diagram illustrating a case in which the sub-block of the backlight unit supports a high dynamic range (HDR) function according to an embodiment of the present disclosure.
Figure 10:
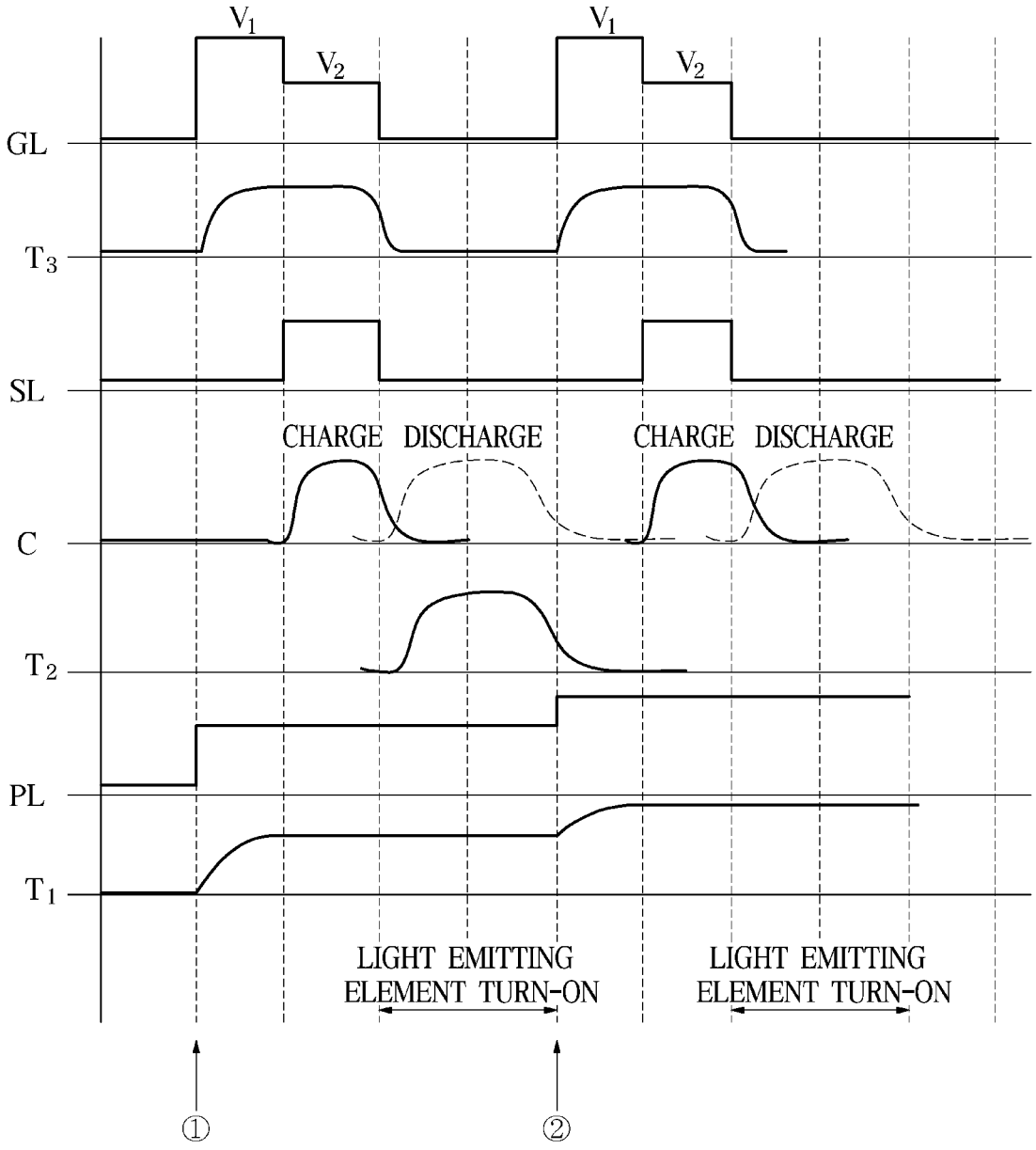
FIG. 10 is a diagram illustrating a switching timing in the sub-block of the backlight unit according to an embodiment of the present disclosure.

FIG. 7 is a diagram illustrating a case in which a gate signal is applied to the sub-block 232 of the backlight unit 200 according to an embodiment of the present disclosure, FIG. 8 is a diagram illustrating a case in which the sub-block 232 of the backlight unit 200 turns on the light emitting element 236 according to an embodiment of the present disclosure, FIG. 9 is a diagram illustrating a case in which the sub-block 232 of the backlight unit 200 supports the high dynamic range (HDR) function according to an embodiment of the present disclosure, and FIG. 10 is a diagram illustrating the switching timing in the sub-block 232 of the backlight unit 200 according to an embodiment of the present disclosure.

Referring to FIG. 7, the backlight unit 200 according to an embodiment may sequentially receive gate signals through the gate lines.

In one of the sub-block 232, when the gate signal is received through the gate line, the third switching element $T_3$ is turned on so that the source voltage through the source line may charge the capacitor C.

Specifically, the third switching element $T_3$ may be turned on when receiving the gate signal from the gate driver 220 through a gate terminal thereof. When turned on, the third switching element $T_3$ may transfer charges to the capacitor C based on the source voltage supplied from the source driver 210 through the drain terminal.

Through this, the capacitor C may be charged with the amount of charges corresponding to the source voltage.

In this case, the source voltage may be determined by the controller 150. Specifically, the controller 150 may determine a luminance corresponding to each of the plurality of sub-blocks 232 based on the image data, and may determine the source voltage corresponding to the luminance for each of the sub-blocks 232 so that the amount of current supplied to the light emitting element 236 corresponds to the luminance by adjusting a magnitude of the gate voltage of the second switching element $T_2$.

When the gate driver 220 supplies a gate signal to one gate line, the controller 150 may control the gate driver 220 to change a voltage level more than once depending on time.

For example, as illustrated in FIG. 10, the controller 150 may control the gate driver 220 such that the gate signal in the gate line is supplied as $V_1$ and then supplied as $V_2$ lower than $V_1$.

This is to compensate for a transient state when the third switching element $T_3$ is turned on by initially applying a higher voltage to perform overdriving. Through this, the third switching element $T_3$ may deviate the transient state more quickly, and may supply a constant current value to the capacitor C depending on the source voltage, thereby improving a luminance level difference.

In this case, the controller 150, in order to enable the source voltage to be transmitted after the third switching element $T_3$ deviates the transient state, may control the source driver 210 such that the source voltage may be supplied after a preset time from a time point when the gate signal starts to be supplied.

For example, as illustrated in FIG. 10, the source voltage may be supplied to the third switching element $T_3$ at a time point when the gate signal is changed from $V_1$ to $V_2$.

Also, when the gate signal is supplied to the third switching element $T_3$, the controller 150 may control the peak driver 240 to start supplying the peak voltage to the first switching element $T_1$.

For example, the controller 150 may control the peak driver 240 to apply the peak voltage at a first time point ① in FIG. 10 when the gate signal is applied.

This is to form a current channel of the first switching element $T_1$ in advance, and to compensate for a transient state when the first switching element $T_1$ is turned on.

That is, the controller 150 controls the peak driver 240 to apply the peak voltage to the gate terminal of the first switching element $T_1$ before the source voltage is applied so that the current channel of the first switching element $T_1$ may deviate the transient state before the actual current is supplied to the light emitting element 236.

Referring to FIG. 8, the sub-block 232 according to an embodiment may supply a current to the light emitting element 236 when the supply of the gate signal to the sub-block 232 is terminated.

Specifically, the capacitor C in which the charges is charged based on the source voltage may transfer the charged charges to the second switching element $T_2$ when the supply of the gate signal is terminated and the third switching element $T_3$ is turned off.

That is, the capacitor C may supply the charges to the gate voltage of the second switching element $T_2$ by discharging the charges charged according to the source voltage to the gate terminal of the second switching element $T_2$.

Through this, the second switching element $T_2$ may supply the current to the light emitting element 236 by forming a current channel. In this case, the second switching element $T_2$ may adjust a magnitude of the current supplied to the light emitting element 236 depending on the magnitude of the gate voltage depending on the amount of charges supplied, and may provide the required luminance by adjusting the amount of light emitted by the light emitting element 236.

As such, the sub-block 232 may supply a current to the light emitting element 236 even when the supply of the gate signal is terminated based on the amount of charges charged in the capacitor C, and thus may secure a long lighting time within a frame unit time, thereby controlling the light emitting element 236 at a low current.

As described above, the controller 150 may determine the luminance required in each of the plurality of sub-blocks 232 based on the image data, and may determine the source voltage corresponding to the amount of light in each of the sub-blocks 232 based on the determined luminance.

That is, the backlight unit 200 may provide the source voltage corresponding to the required luminance in units of the sub-blocks 232, and the sub-blocks 232 may adjust a degree of the current channel of the second switching element $T_2$ depending on the source voltage, thereby adjusting the amount of current supplied to the light emitting element 236. In other words, the controller 150 may adjust the amount of light emitted by the light emitting element 236 by adjusting the magnitude of the source voltage, thereby providing a corresponding luminance.

In this case, the first switching element $T_1$ may receive the peak voltage of a preset magnitude as the gate voltage to supply the current to the second switching element $T_2$. Through this, the display apparatus 1 may supply the current to the light emitting element 236 through the first switching element $T_1$ and the second switching element $T_2$ based on the driving voltage $V_{DD}$ supplied from the power supply 140, and the amount of current supplied to the light emitting element 236 may be determined based on the amount of charges supplied to the second switching element $T_2$.

That is, the first switching element $T_1$ may receive the peak voltage of the preset magnitude as the gate voltage within a preset luminance range. However, the first switching element $T_1$ may receive a higher peak voltage as the gate voltage when a luminance greater than a preset value is required.

Referring to FIG. 9, the controller 150 according to an embodiment may determine the sub-block 232 that requires the luminance equal to or greater than the preset value among the plurality of sub-blocks 232 based on the image data.

The controller 150 may determine the sub-block 232 corresponding to a high luminance in order to support the HDR function, and may increase the peak voltage applied to the gate voltage of the first switching element $T_1$ in order to supply a larger amount of current to the light emitting element 236 in the determined sub-block 232.

Specifically, the controller 150 may determine the peak voltage corresponding to the determined sub-block 232 to be greater than or equal to the preset value to increase the amount of current transferred from the first switching element $T_1$ to the light emitting element 236 through the second switching element $T_2$.

The controller 150 may determine the peak voltage to be greater than or equal to the preset value by increasing an absolute magnitude of the peak voltage, according to an embodiment.

Also, the controller 150 may determine the peak voltage to be greater than or equal to the preset value by increasing a duty ratio of the peak voltage, according to an embodiment.

In this case, the controller 150 may determine the peak voltage proportionally as the luminance in a high luminance region (e.g., 500 luminance to 4000 luminance) increases.

Through this, as the luminance increases, the current channel of the first switching element $T_1$ may increase, so that the amount of current supplied to the light emitting element 236 may increase. The controller 150 may determine the source voltage, which determines the amount of charges supplied to the second switching element $T_2$, to have a maximum magnitude.

For example, as illustrated in FIG. 10, when the luminance required in the frame after the first time point ① is a luminance within the high luminance range, the controller 150 may control the peak driver 240 to increase the peak voltage to the preset value or more at a second time point ② when the next frame starts.

Through this, the display apparatus 1 may adjust the peak voltage applied to the third switching element $T_3$ which is a separate switching element to provide a high luminance that is difficult to implement with only the source voltage, thereby providing the HDR function in which the luminance range is widened.

Hereinafter, an embodiment of a method of controlling the display apparatus 1 according to an aspect will be described. The display apparatus 1 according to the above-described embodiment may be used as a method of controlling the display apparatus 1. Therefore, the contents described above with reference to FIGS. 1 to 10 may be equally applied to the control method of the display apparatus 1.

Figure 11:
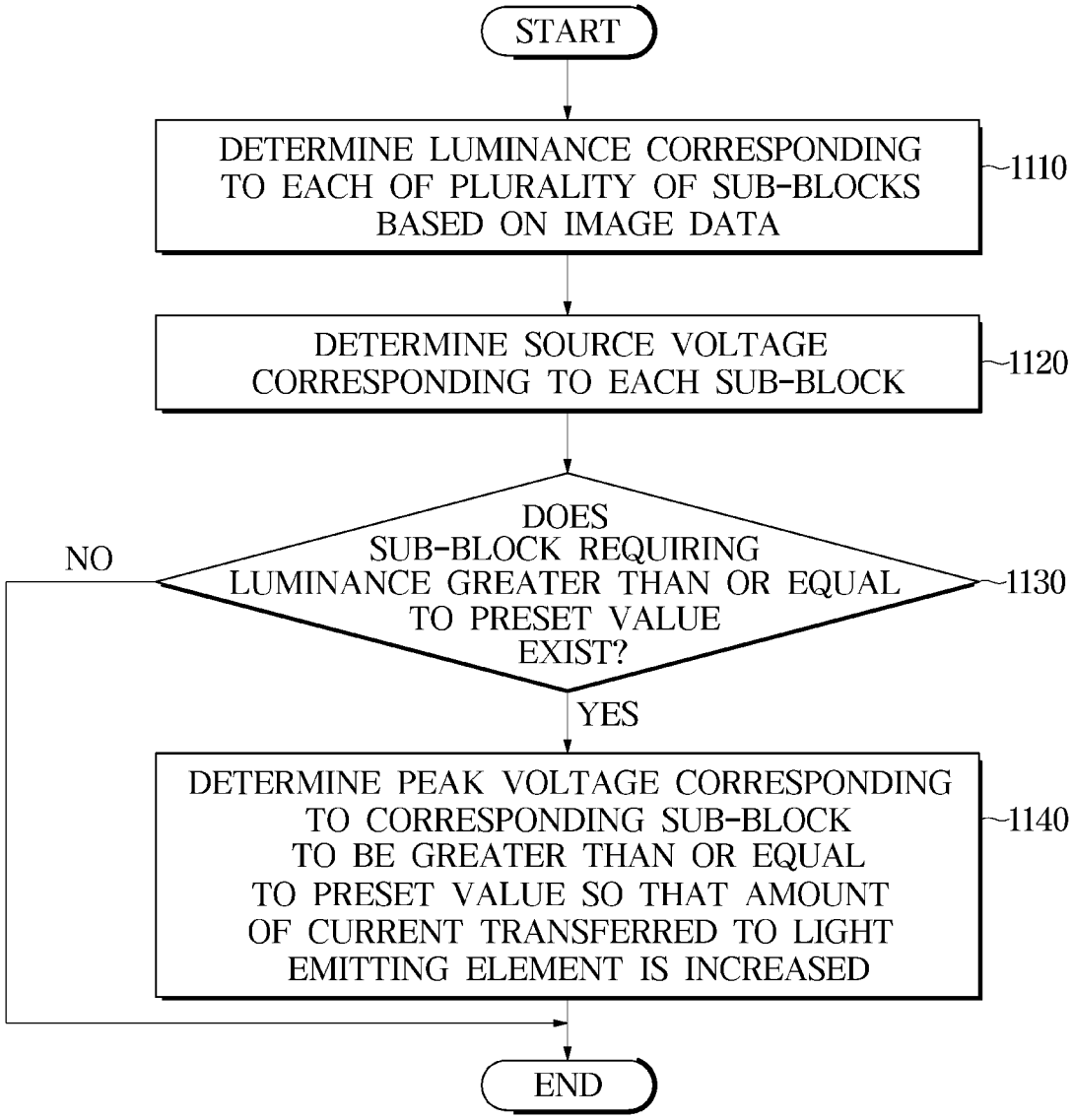
FIG. 11 is a flowchart illustrating of a method in which a switching element is controlled to adjust a current supplied to the light emitting element in a method of controlling the display apparatus according to an embodiment of the present disclosure.

FIG. 11 is a flowchart illustrating a case in which the switching elements $T_1$, $T_2$, and $T_3$ are controlled to adjust a current supplied to the light emitting element 236 in a method of controlling the display apparatus according to an embodiment of the present disclosure.

Referring to FIG. 11, in operation 1110, the display apparatus 1 according to an embodiment may determine a luminance corresponding to each of the plurality of sub-blocks 232 based on image data.

The controller 150 of the display apparatus 1 may determine the luminance corresponding to each of the plurality of sub-blocks 232 based on the image data obtained through the content receiver 120 or the communicator 130.

In operation 1120, the display apparatus 1 according to an embodiment may determine a source voltage corresponding to the luminance of each of the sub-blocks 232.

The controller 150 may determine the luminance required in each of the plurality of sub-blocks 232 based on the image data, and may determine a source voltage corresponding to the amount of light in each of the sub-blocks 232 based on the determined luminance.

That is, the backlight unit 200 may provide a source voltage corresponding to the required luminance in units of the sub-blocks 232, and the sub-block 232 may adjust the degree of the current channel of the second switching element $T_2$ depending on the source voltage, thereby adjusting the amount of current supplied to the light emitting element 236. In other words, the controller 150 may adjust the amount of light emitted by the light emitting element 236 by adjusting the magnitude of the source voltage, thereby providing a corresponding luminance.

In this case, in operation 1130, when the sub-block 232 requiring a luminance greater than or equal to the preset value exists (YES of operation 1130), the display apparatus 1 according to an embodiment, in operation 51140, the display apparatus 1 according to an embodiment may determine the peak voltage corresponding to the corresponding sub-block to be greater than or equal to the preset value so that the amount of current transferred to the light emitting element 236 is increased. Otherwise, the method ends (NO of operation 1130)

The controller 150 may determine the sub-block 232 corresponding to a high luminance in order to support the HDR function, and may increase the peak voltage applied to the gate voltage of the first switching element $T_1$ in order to supply a larger amount of current to the light emitting element 236 in the determined sub-block 232.

The controller 150 may determine the peak voltage proportionally as the luminance in a high luminance region (e.g., 500 luminance to 4000 luminance) increases. Accordingly, as the luminance increases, the current channel of the first switching element $T_1$ may increase, so that the amount of current supplied to the light emitting element 236 may increase.

Through this, the display apparatus 1 may adjust the peak voltage applied to the third switching element $T_3$ which is a separate switching element to provide a high luminance that is difficult to implement with only the source voltage, thereby providing the HDR function in which the luminance range is widened.

Herein, the disclosed embodiment may be implemented in the form of a recording medium storing instructions executable by a computer. The instructions may be stored in the form of program code, and when executed by a processor, a program module may be created to perform the operations of the disclosed embodiment. The recording medium may be implemented as a computer-readable recording medium.

The computer-readable recording medium includes various kinds of recording media in which instructions which may be decrypted by a computer are stored. For example, there may be a ROM, a RAM, a magnetic tape, a magnetic disk, a flash memory, an optical data storage device, and the like.

Although embodiments of the disclosure have been described above, it will be understood by those skilled in the art that various changes in form and details may be made therein without departing from the spirit and scope of the disclosure as defined by the appended claims. The disclosed embodiments are illustrative and should not be construed as limiting.

What is claimed is:

1. A display apparatus comprising:

a liquid crystal panel;

a power supply;

a backlight unit comprising a plurality of sub-blocks configured to radiate light to the liquid crystal panel; and a controller configured to determine a peak voltage and a source voltage supplied to each of the plurality of sub-blocks, wherein each of the plurality of sub-blocks comprises:

a first switching element configured to receive the peak voltage as a gate voltage;

a second switching element comprising a drain terminal connected to a source terminal of the first switching element, the second switching element being configured to receive an amount of charges corresponding to the source voltage through a gate terminal; and a light emitting element connected in series with a source terminal of the second switching element, the light emitting element being configured to receive a first current from the power supply through the first switching element and the second switching element, and wherein the controller is further configured to:

determine a sub-block requiring a luminance greater than or equal to a preset luminance value among the plurality of sub-blocks based on image data; and determine the peak voltage corresponding to the luminance required by the determined sub-block to be greater than or equal to a preset voltage value.

2. The display apparatus of claim 1, wherein the backlight unit further comprises a gate driver configured to supply a gate signal to the plurality of sub-blocks, and wherein each of the plurality of sub-blocks further comprises:

a capacitor configured to supply the gate voltage to the second switching element based on charges that are charged depending on the source voltage; and a third switching element configured to transfer the charges to the capacitor based on the source voltage supplied as a drain voltage upon being turned on by the gate signal supplied from the gate driver.

3. The display apparatus of claim 2, wherein the controller is further configured to:

determine a luminance of each of the plurality of sub-blocks based on the image data, and determine a source voltage such that a second current supplied to the light emitting element corresponds to the determined luminance of each of the plurality of sub-blocks by adjusting a magnitude of the gate voltage of the second switching element.

4. The display apparatus of claim 2, wherein the controller is further configured to control the gate driver to change a voltage level one or more times depending on time in a supply of the gate signal.

5. The display apparatus of claim 2, wherein the controller is further configured to control to start supplying the peak voltage to the first switching element in response to the gate signal being supplied to the third switching element.

6. The display apparatus of claim 5, wherein the controller is further configured to:

determine the peak voltage corresponding to the determined sub-block such that an amount of current transferred from the first switching element to the light emitting element through the second switching element is increased.

7. The display apparatus of claim 5, wherein the controller is further configured to:

adjust a duty ratio of the peak voltage corresponding to the determined sub-block such that an amount of current transferred from the first switching element to the light emitting element through the second switching element is increased.

8. The display apparatus of claim 2, wherein the third switching element comprises a source terminal connected to the gate terminal of the second switching element and one end of the capacitor.

9. The display apparatus of claim 2, wherein the capacitor comprises a first end connected to the gate terminal of the second switching element and a second end connected to the source terminal of the second switching element.

10. The display apparatus of claim 2, wherein the capacitor is further configured to transfer the charged charges to the second switching element in response to the third switching element being turned off.

11. A control method of a display apparatus, the display apparatus comprising a liquid crystal panel; a power supply; and a backlight unit comprising a plurality of sub-blocks provided with a first switching element configured to receive a peak voltage as a gate voltage, and a second switching element comprising a drain terminal connected to a source terminal of the first switching element and configured to receive an amount of charges corresponding to a source voltage, the control method comprising:

determining a luminance corresponding to each of the plurality of sub-blocks based on image data;

determining a source voltage corresponding to the determined luminance of each of the plurality of sub-blocks;

determining a sub-block, among the plurality of sub-blocks, requiring a luminance greater than or equal to a preset luminance value; and determining a peak voltage corresponding to the luminance required by the determined sub-block to be greater than or equal to a preset voltage value.

12. The control method of claim 11, wherein each of the plurality of sub-blocks further comprises a light emitting element connected in series with a source terminal of the second switching element, the light emitting element being configured to receive a current from the power supply through the first switching element and the second switching element.

13. The control method of claim 12, wherein the backlight unit further comprises a gate driver configured to supply a gate signal to the plurality of sub-blocks, and wherein each of the plurality of sub-blocks further comprises:

a capacitor configured to supply the gate voltage to the second switching element based on charges that are charged depending on the source voltage; and a third switching element configured to transfer the charges to the capacitor based on the source voltage supplied as a drain voltage upon being turned on by the gate signal supplied from the gate driver.

14. The control method of claim 13, further comprising:

controlling the gate driver to change a voltage level one or more times depending on time in the supplying of the gate signal.

15. The control method of claim 13, further comprising:

controlling to start supplying the peak voltage to the first switching element in response to the gate signal being supplied to the third switching element.

* * * * *